United States Patent [19]

Pope et al.

[11] 4,342,991

[45] Aug. 3, 1982

[54] PARTIAL SCROLLING VIDEO GENERATOR

[75] Inventors: Richard N. Pope, San Ramon; Richard A. Williamson, Danville, both of Calif.

[73] Assignee: Multisonics, Inc., Dublin, Calif.

[21] Appl. No.: 128,347

[22] Filed: Apr. 10, 1980

[51] Int. Cl.[3] ..... G09G 1/16

[52] U.S. Cl. ..... 340/726; 340/744; 340/792

[58] Field of Search ..... 340/726, 724, 723, 744, 340/748, 792

[56] References Cited

U.S. PATENT DOCUMENTS

| | | | |
|---|---|---|---|
| 3,406,387 | 10/1968 | Werme | 340/726 |
| 3,643,252 | 2/1972 | Roberts, Jr. | 340/726 |
| 3,792,462 | 2/1974 | Casey et al. | 340/726 |
| 3,903,510 | 9/1975 | Zobel | 340/726 |

*Primary Examiner*—Marshall M. Curtis

*Attorney, Agent, or Firm*—Townsend and Townsend

[57] ABSTRACT

A raster scan cathode ray tube (CRT) display system which is capable of indirectly addressing data to be displayed in an manner presenting the data on any selected row or group of rows, in any order. A scrolling system according to the invention includes a cathode ray tube controller (CRTC) coupled to an indirect address counter which is coupled together with a presettable counter through a multiplexer (MUX) to the address port of a CRT display refresh memory (RAM), a segment of the data output port of the refresh memory being coupled to the preset port of the presettable counter. The invention operates by generating a refresh address indirectly through the presettable counter which addresses pointers in the refresh memory, each pointer containing the absolute address of the beginning of a specific line of data in the refresh memory which is to be displayed. During the blanking interval of the display, data is addressed by the indirect address counter. During other intervals, the address presented to the refresh memory is generated by the refresh address counter (the presettable binary counter). The address which is provided at the refresh address counter dictates the line of characters which are therafter displayed.

8 Claims, 1 Drawing Figure

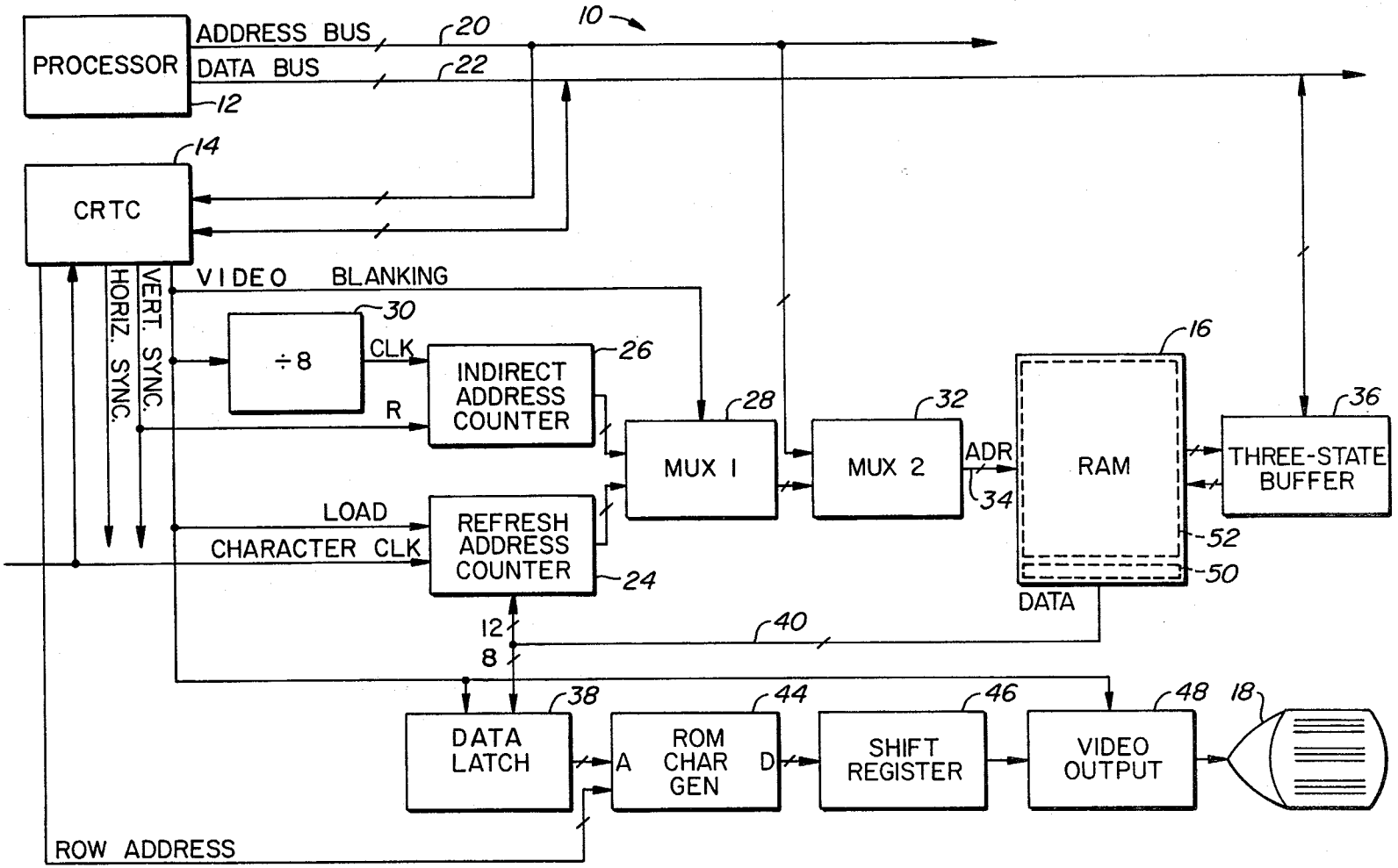
THREE-STATE BUFFER
36
RAM
16
52
50
DATA
ADR
34
MUX 2
32
MUX I
28
INDIRECT ADDRESS COUNTER
26
REFRESH ADDRESS COUNTER
24
÷8
30
CLK
R
LOAD
CHARACTER CLK
BLANKING
VIDEO
VERT. SYNC.
HORIZ. SYNC.
CRTC
14
PROCESSOR
12
ADDRESS BUS
DATA BUS
20
22
10
40
12
8
DATA LATCH
38
ROM CHAR GEN
44
A
D
SHIFT REGISTER
46
VIDEO OUTPUT
48
18
ROW ADDRESS

PARTIAL SCROLLING VIDEO GENERATOR

BACKGROUND OF INVENTION

1. Field of Invention

This invention relates to raster scan video display devices, and particularly to a control system for a cathode ray tube (CRT) terminal intended primarily for display of graphics or alphanumeric characters in definable lines or sets of lines. The invention is intended for use with microprocessor units, central processor units and other data sources capable of providing encoded digital data to a refresh memory, that is, a memory which is operative to restore all data representative of information to be displayed substantially simultaneously on a CRT screen.

2. Description of the Prior Art

In the past, typical raster scan CRT display systems have provided only a direct spatial representation of data stored in its related refresh memory. The data from a data source were supplied to a refresh memory and all addressing has been presented to the refresh memory from a CRT controller (CRTC) via an address multiplexer (MUX). The CRTC has normally presented all addressing to the MUX specifying the specific location of data to be displayed. Hence, data stored in specific addresses within the refresh memory were displayed only at the screen location directly corresponding to the refresh memory addresses.

Scrolling of the display, i.e., advancing selected lines across the display in a queue, has generally been accomplished by the conventional technique of relocating all data in absolute memory. Conventional scrolling techniques involving line by line relocation are noticeably slow and cumbersome. Partial screen scrolling has generally not been implemented since substantial interaction with the data source, e.g., the processor, has been required by conventional techniques, which detracts from other functions of the processor. What is therefore needed is a CRT raster scan display system, particularly a system capable of partial scrolling, which maximizes speed and efficiency of scrolling while minimizing the interaction between the data source and the refresh memory once data has been initially loaded into the refresh memory.

SUMMARY OF THE INVENTION

According to the invention, a raster scan cathode ray tube (CRT) display system is provided which is capable of indirectly addressing data to be displayed in a manner presenting the data on any selected row or group of rows in any order. In particular, a scrolling system according to the invention comprises a cathode ray tube controller (CRTC) coupled to an indirect address counter which is coupled together with a presettable counter through a multiplexer (MUX) to the address port of a CRT display refresh memory (RAM), a segment of the data output port of the refresh memory being coupled to the preset port of the presettable counter. The invention operates by generating a refresh address indirectly through the presettable counter which addresses pointers in the refresh memory, each pointer containing the absolute address of the beginning of a specific line of data in the refresh memory which is to be displayed. During the blanking interval of the display, data is addressed by the indirect address counter. During other intervals, the address presented to the refresh memory is generated by the refresh address counter (the presettable binary counter). The address which is provided at the refresh address counter dictates the line of characters which is thereafter displayed.

The inventive system has a number of advantages over known techniques. First of all, each absolute address of the refresh memory is loaded only once, which saves time and input overhead. Second, the associated CRTC presents only row address, blanking and vertical synchronization to the refresh memory subsystem. The normal addressing functions of a CRTC are not employed.

Partial scrolling and even full page scrolling can be externally controlled by relatively simple commands from the processor or other control devices. Specifically, the processor may be operative to load pointer data into pointer addresses of the refresh memory each time the screen display is to be modified. Hence, only one word of data per display line requires changing in the course of a scrolling operation.

These and other advantages and objects of the invention will be apparent upon reference to the following detailed description taken in connection with the following figure.

BRIEF DESCRIPTION OF THE DRAWING

The single FIGURE is a block diagram of a raster scan type cathode ray tube display system having partial scrolling capability.

DETAILED DESCRIPTION OF SPECIFIC EMBODIMENTS

The invention is described with reference to specific embodiments. Other embodiments will be apparent upon reference to the following detailed description. Referring to the single FIGURE there is shown a cathode ray tube based system 10 comprising a processor 12, such as a microprocessor unit, a cathode ray tube controller (CRTC) 14, a refresh memory 16 which is a random access memory (RAM), a cathode ray tube display (CRT) 18, and specific control circuitry as hereinafter described.

The system 10 is intended for use in processor-based interactive display systems involving controllers for CRT terminals in stand-alone or cluster configurations. For this purpose, the processor 12 may have other functions not pertinent to this invention. Generally, however, the processor 12 employs an address bus 20 and a data bus 22. Via the address bus 20 and the data bus 22 the CRTC 14 transmits and receives digital instructions and data. Normally all keyboard functions, including read and write, cursor movements, if any, and editing, are under control of the processor 12. The CRTC 14 provides video timing and, in connection with the other circuitry hereinafter explained, refresh memory addressing. A suitable device for the CRTC 14 is a Type MC6845 controller manufactured by Motorola. An equivalent discrete component system could be substituted for the CRTC 14 functions which are employed in this invention.

The CRTC 14 provides three timing outputs pertinent to the invention, namely video blanking, vertical synchronization, and row address, row address being provided by a bus line. A character clock (not shown) is derived from a master clock external to the system 10. The master clock also drives other subsystems such as the video output circuitry.

The object of the invention is to generate refresh memory addresses such that the addresses in the refresh memory 16 need not have an absolute correspondence to fixed character locations on the video display 18. This function is accomplished according to the invention by eliminating the refresh memory addressing from the CRTC 14 of conventional design and substituting a presettable binary counter as a refresh address counter 24 and an indirect address counter 26 which alternatively access the address input 34 of refresh memory 16 through a first multiplexer 28 (MUX 1).

Specifically, the video blanking output of the CRTC 14 drives a LOAD input of a refresh address counter 24, the switching of the first multiplexer 28, and the clock input of the indirect address counter 26. (The clock input of the indirect address counter 26 is processed through a divide-by-8 circuit 30. The selected value is equal to the number of horizontal lines required for one character line.) The reset input of the indirect address counter 26 is driven by the vertical sync line of the CRTC 14, and the clock input of the refresh address counter 24 is driven by the external character clock. The data bus 40 of the refresh memory 16 is coupled to the data terminals of the refresh address counter 24. The outputs of the refresh address counter 24 and indirect address counter 26 are coupled to the dual-input multiplexer 28 (MUX 1). A second multiplexer 32 is provided between the output of the first multiplexer 28 and the address input 34 of the refresh memory 16. The other input of the second multiplexer 32 is coupled from the address bus 20 by which address information is communicated to the refresh memory 16 from the processor 12. Any data access between the refresh memory 16 and the processor 12 is provided via a three-state buffer 36 through the data bus 22. Other schemes may be used to pass data between the refresh memory 16 and the processor 12.

Further subsystems are required to render the system 10 fully functional, including a latch 38 having a data input port from data bus 40 out of the refresh memory 16, a ROM character generator 44 driven by the row address output of the CRTC 14 and the address output of the latch 38, a serial shift register 46 provided video data by the data output of the ROM character generator 44 and a video output subsystem 48 which converts serialized digital information into drive signals for the CRT 18.

The logic circuitry employed in connection with the refresh memory 16 which operates independently of the processor 12 is hereafter termed the refresh logic. The circuitry employed to generate video data is hereafter termed the display circuitry.

In order to more fully understand the invention, it is necessary to understand the structure and operation of key components. Referring particularly to the refresh memory 16, the refresh memory 16 comprises two matrices, a first matrix 50 and a second matrix 52. The first matrix 50 is a single column matrix of the same rank as the second matrix 52. The first matrix comprises storage for indirect address pointers of base address locations of rows of the second matrix 52. The second matrix 52 has a rank and order corresponding to the page size of the display device 18 and comprises storage for data to be presented to the display circuitry.

The refresh address counter 24 is essentially a column counter, that is, its function is limited essentially to incrementing character position. The indirect address counter 26 is a row pointer. Its function is to address the first matrix and to increment through the first matrix. Whenever the first matrix 50 is addressed, the system automatically recognizes that the data supplied to the data bus 40 is an address which is to be loaded into the refresh address counter 24. Generally the higher order bits of the address specify the row whereas the lower order bits specify the column position. It is customary to initialize the column character position to a virtual address of zero.

According to the invention, the indirect address counter 26 and the refresh address counter 24 cooperate with the first matrix 50 and the second matrix 52 of the refresh memory 16 to indirectly derive base address information on the line to be presented. In operation, the first matrix 50 is loaded with the address of the first character of each line or row to be displayed and the second matrix 52 is loaded with the conventional character code for data to be displayed. Each time the CRTC 14 instructs the refresh logic to refresh the video display, the indirect address counter 26 is initially activated to attempt to read the refresh memory 16. The indirect address counter 26 invariably starts at the first location in the first matrix 50 causing the data in that location to be transferred and loaded into the refresh address counter 24 upon a LOAD signal activated by the video blanking output of the CRTC 14. At the termination of the video blanking signal, control of the refresh memory 16 is transferred to the refresh counter 24 through switching of the first multiplexer 28.

The refresh address counter 24 then provides the address the refresh memory 16. The address supplied to the address input 34 of the refresh memory 16, which has been derived from the first matrix 50, is the first character location of the selected row in the second matrix 52. Thereupon, the addressed data is read into the display circuitry where it is latched in latch 38. The latch data then addresses the ROM character generator 44, generating the specified code for the picture element corresponding thereto. The picture element data is then serialized in a shift register 46 and converted to a signal at the video output 48 which is displayed on the video display device 18. The external character clock causes the refresh address counter 24 to increment the value stored therein, incrementing the address applied to the address input 34 of refresh memory 16 and reading the data into the display circuitry as before. The character clock continues to increment in this manner until a LOAD signal presets the refresh address counter 24. After eight rows of raster scan, the indirect address counter 26 is also incremented, which increments the row or line. The refresh address counter 24 is reloaded with the new base address from the next location in the first matrix 50, and the control of the address input 34 is transferred again to the refresh address counter 24, which repeats the sequence of scanning all characters in the row until the row has been refreshed. Thereafter, the indirect address counter 24 is again incremented and the process repeated until all locations to be displayed of the first matrix 50 have been addressed and serviced.

A raster scan type cathode ray tube display system of the type herein described has several advantages. First of all, the scrolling of rows of characters is accomplished merely by writing sequentially the base addresses of the rows of characters to be displayed in the first matrix 50. This is generally done under software control through the processor 12 by a simple writing process wherein the addresses in the first matrix 50 are merely rearranged according to the desired display sequence. Thus, to scroll all lines of a display, all base addresses beginning with the first and concluding with the second to last address of the display are incremented, and the last location is replaced with the address previously found in the first location of the first matrix 50. If, for example, only a limited selection of rows are to be scrolled, such partial scrolling is accomplished by merely rearranging the base addresses in the specific locations in the first matrix. The indirect addressing feature automatically instructs the refresh logic to display the designated row in the second matrix 52 at the next display row.

The invention has now been explained with reference to specific embodiments. Other embodiments will be apparent to those of ordinary skill in the art with reference to this disclosure. It is therefore not intended that the invention be limited except as indicated by the appended claims.

What is claimed is:

1. A method for use in scrolling display rows in a raster scan type cathode ray tube display system wherein the display system includes a video display, refresh logic, a refresh memory, a first counter and a second counter, said refresh memory having storage locations arranged in a first matrix and a second matrix, said first matrix comprising storage for indirect address pointers of preselected base address locations for rows of said second matrix, said second matrix comprising fixed address storage for data to be presented for output to said video display, said method comprising the steps of:

(a) writing a base address pointer for each row into said first matrix;

(b) reading, according to an address value in said first counter, a base address pointer from a location in said first matrix which points to the base address of a row in said second matrix so as to supply the base address to the address input of said refresh memory; thereupon (c) reading for output to said video display, according to a value in said second counter containing the current column address, data in said second matrix at the current column and row address;

(d) incrementing said second counter containing the current column and row address to advance the column address;

(e) repeating steps (c) and (d) until the end of the row is serviced;

(f) incrementing said first counter to access a next sequential address in said first matrix;

(g) repeating steps (b) through (f) to present a plurality of rows of data in said second matrix to said video display.

2. The method as claimed in claim 1 wherein said writing step further includes modifying selected ones of said base addresses in said first matrix from time to time in order to alter the sequence of presentation of selected ones of said rows.

3. The method as claimed in claim 2 further including the step of limiting the number of base addresses which are altered.

4. The method as claimed in claim 2 further including the step of starting at other than the first address value location in said first matrix in order to limit the number rows which are refreshed.

5. A method for use in scrolling rows in a raster scan type cathode ray tube display system wherein the system includes a video display, refresh logic and a refresh memory operative in response to write signals to store data information for subsequent display according to address information and operative in response to read signals at an address input to present data information at a data output, said refresh memory having storage locations arranged in a first matrix and a second matrix, said first matrix comprising storage for indirect address pointers of base addresses of rows of said second matrix, said second matrix comprising storage for data to be presented to said video display, said method comprising the steps of:

(a) writing display data into said refresh memory in said second matrix;

(b) writing base address information into said refresh memory in said first matrix, said base address information being arranged in a queue in said first matrix;

(c) causing said refresh memory to read a base address of a row from a current location of said first matrix as an indirect address and supplying said base address as a current location to the address input of said refresh memory;

(d) causing said refresh logic to read into said video display the data at the current location of the specified row in said second matrix in order to provide a video output signal;

(e) incrementing a column counter in response to a character clock in order to increment column location from said base address location in said second matrix;

(f) repeating steps (c) and (d) until said column counter is preset;

(g) incrementing an indirect address counter synchronously with a preset signal to said column counter in order to advance the current location of said first matrix;

(h) repeating steps (c) through (g) in order to present all rows of said second matrix for refreshing said display.

6. The method according to claim 5 wherein the base address writing step further includes the step of modifying selected ones of said base addresses in said first matrix from time to time in order to alter the sequence of display of said rows.

7. An apparatus for use in a raster scan type cathode ray tube display system in connection with a processor having an address bus and a data bus, and a video display device, said apparatus comprising:

refresh logic and a refresh memory, said refresh memory comprising address input terminals and data output terminals and digital data storage locations arranged in a first matrix and a second matrix, said first matrix being limited to storage for indirect address pointers of preselected base address locations of rows of said second matrix, said second matrix comprising fixed address storage for data to be presented to said video display device, said refresh logic comprising a refresh address counter coupled between said data output terminals of said refresh memory and said address input terminals of said refresh memory for addressing column locations of said refresh memory, said refresh logic further comprising an indirect address counter coupled to said address input terminals of said refresh memory for addressing said first matrix and thereby row pointers of said second matrix.

8. The apparatus as claimed in claim 7 further including a multiplexer disposed in an address bus between the input address port of said refresh memory at output port terminal, said indirect address counter at a first input port and a refresh address counter at a second input port, said multiplexer being subject to switch-over under control of a video blanking signal.

* * * * *

UNITED STATES PATENT AND TRADEMARK OFFICE

CERTIFICATE OF CORRECTION

PATENT NO. : 4,342,991

DATED : August 3, 1982

INVENTOR(S) : Richard N. Pope and Richard A. Williamson

It is certified that error appears in the above—identified patent and that said Letters Patent is hereby corrected as shown below:

On the title page under Section [22] delete

"Filed: April 10, 1980" and substitute

--Filed: March 10, 1980--

Signed and Sealed this

*Twenty-eighth* Day of *February 1984*

[SEAL]

*Attest:*

GERALD J. MOSSINGHOFF

*Attesting Officer*

*Commissioner of Patents and Trademarks*